US005951054A

United States Patent [19]

Hagen et al.

[11] Patent Number: 5,951,054

[45] Date of Patent: Sep. 14, 1999

[54] CORE RELEASE LAYER LABEL CONSTRUCTIONS

[75] Inventors: Ronald G. Hagen, Larsen; Amy T. Gustafson, Appleton; Kristi B. Carr, Neenah, all of Wis.; Cherylann C. Kasmirski, White Bear Lake, Minn.; Perry A. Peterman, Neenah, Wis.

[73] Assignee: Menasha Corporation, Neenah, Wis.

[21] Appl. No.: 08/873,630

[22] Filed: Jun. 12, 1997

[51] Int. Cl.[6] ..... B42D 15/00

[52] U.S. Cl. ..... 283/81; 283/101; 428/40.1

[58] Field of Search ..... 283/81, 79, 80, 283/101, 38, 40.1, 41.7, 41.8; 40/299, 630

[56] References Cited

U.S. PATENT DOCUMENTS

| | | | |
|---|---|---|---|
| 3,503,835 | 3/1970 | Hermann | 161/38 |
| 4,157,410 | 6/1979 | McClintock | 428/40 |
| 4,264,388 | 4/1981 | McClintock | 156/152 |
| 4,389,270 | 6/1983 | McClintock | 156/218 |
| 4,726,972 | 2/1988 | Instance | 428/40 |
| 4,857,371 | 8/1989 | McClintock | 428/36.5 |
| 4,863,772 | 9/1989 | Cross | 428/40 |
| 5,052,718 | 10/1991 | Gold | 283/105 |
| 5,090,942 | 2/1992 | Traise | 462/66 |
| 5,139,286 | 8/1992 | Gold | 285/105 |
| 5,283,093 | 2/1994 | All | 428/41 |
| 5,449,538 | 9/1995 | Denny | 428/40 |
| 5,534,320 | 7/1996 | Raby | 283/101 X |
| 5,543,190 | 8/1996 | Johnson | 281/38 |
| 5,597,648 | 1/1997 | Hanneman et al. | 428/40.7 |
| 5,639,125 | 6/1997 | Garrison | 283/101 X |
| 5,651,852 | 7/1997 | Mitchell | 283/101 X |
| 5,653,473 | 8/1997 | Laszutko et al. | 283/101 X |

FOREIGN PATENT DOCUMENTS

| | | |
|---|---|---|
| 0 512 153 | 11/1992 | European Pat. Off. . |
| 0 607 679 | 7/1994 | European Pat. Off. . |
| 27 35 482 | 9/1978 | Germany . |

OTHER PUBLICATIONS

Applicant's Exhibit A—Fasson Graphic Arts Division, 250 Chester Street, Painesville, OH 44077; "Fasson Roll Printer News", Fall 1975; 10 pages.

*Primary Examiner*—Willmon Fridie, Jr.
*Attorney, Agent, or Firm*—Quarles & Brady

[57] ABSTRACT

A three-ply label construction has a core release layer which has both sides coated with a release material. Pressure-sensitive label layers are releasably adhered to both sides of the core release layer. The core release layer can be folded to make a booklet construction, rolled to a make a rolled construction, or perforated to define a fold or tear line. An edge of one of the outer label layers extends past the core layer so as to expose an area of adhesive overlapping the opposite leaf of a folded construction to hold the folded construction closed.

13 Claims, 3 Drawing Sheets

FIG. 1
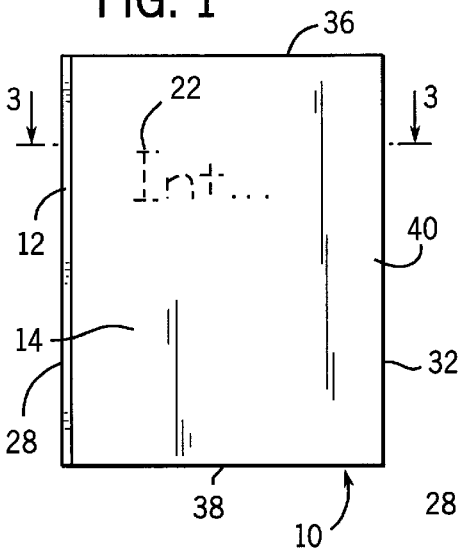
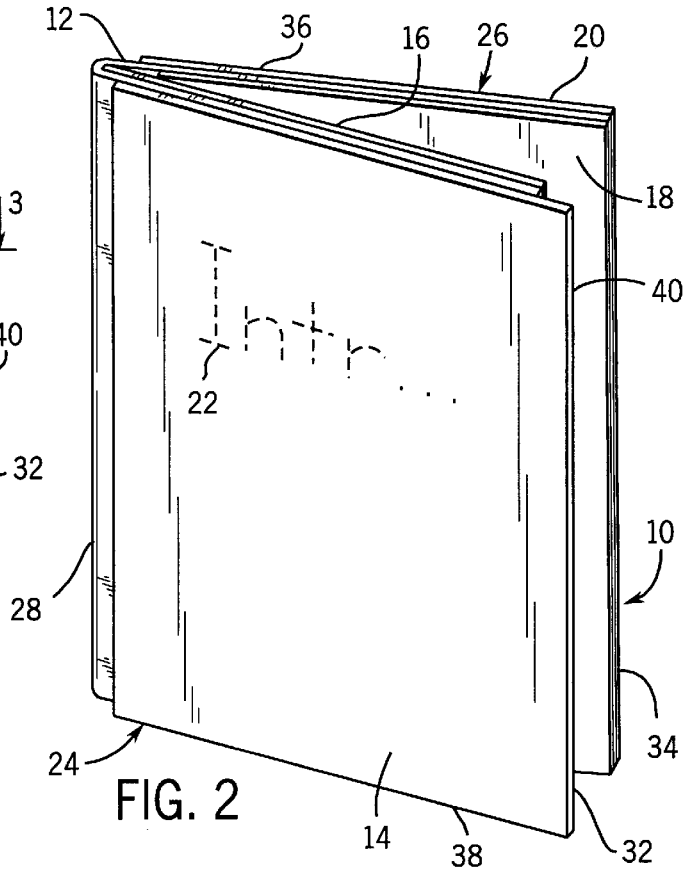
FIG. 2
FIG. 3
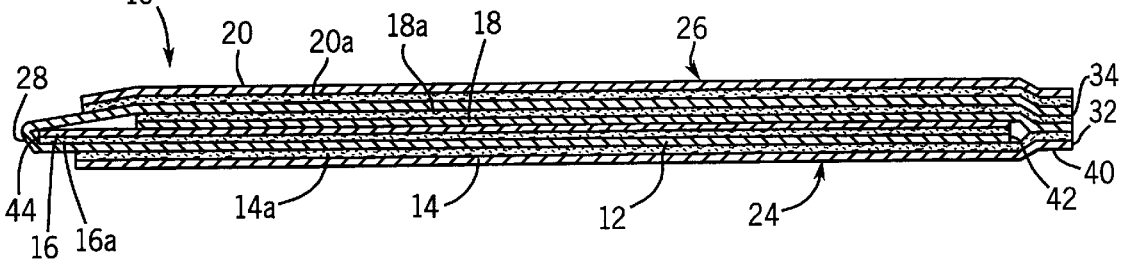
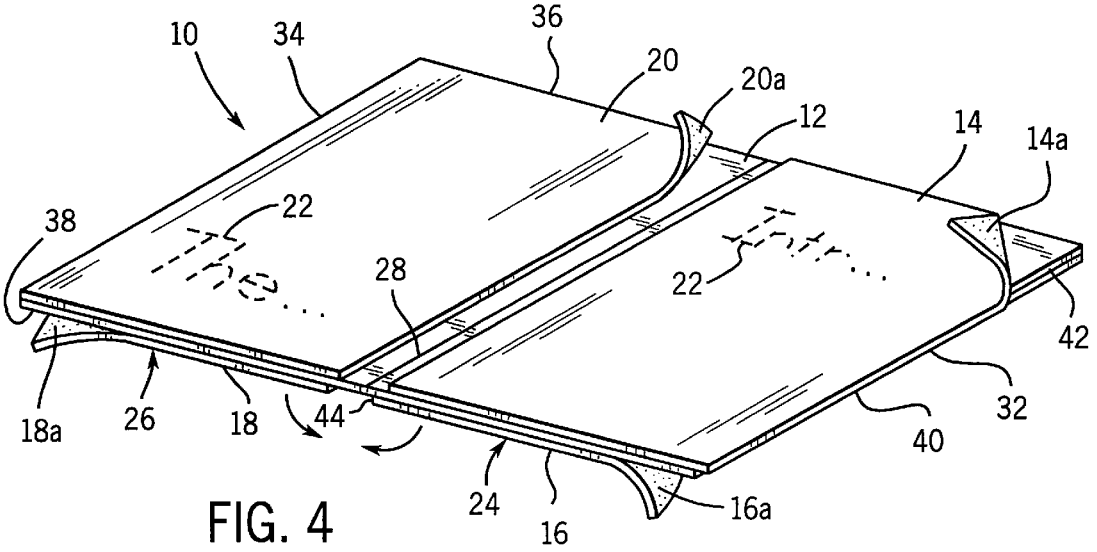
FIG. 4

FIG. 5
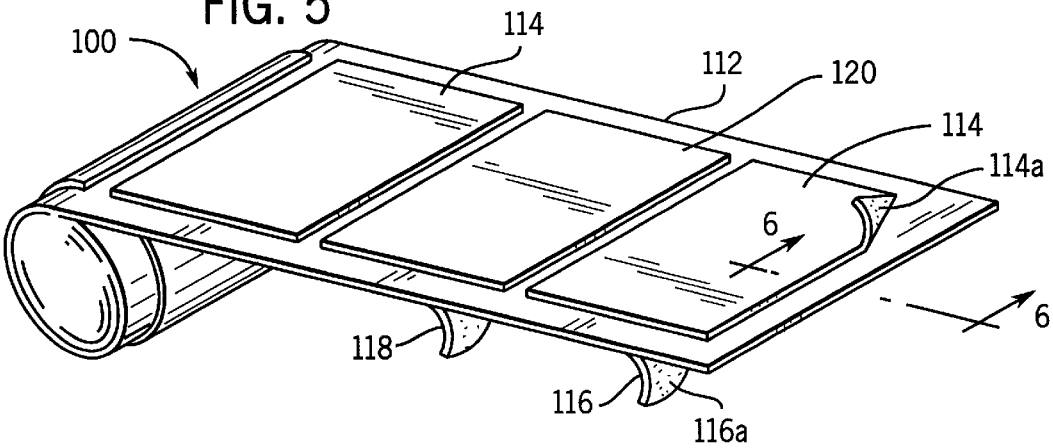
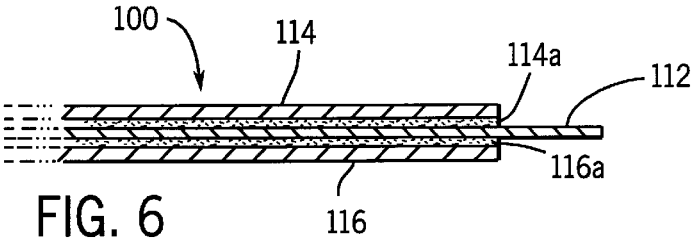
FIG. 6
FIG. 7
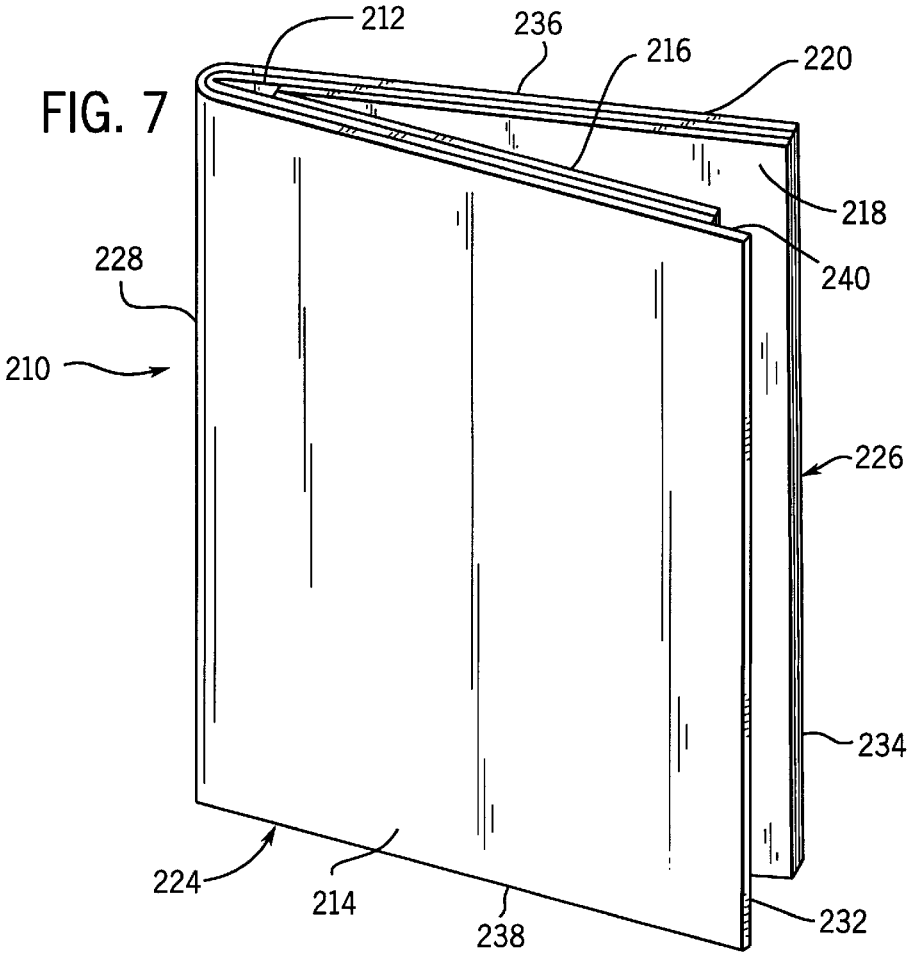

CORE RELEASE LAYER LABEL CONSTRUCTIONS

BACKGROUND OF THE INVENTION

1. Field of the Invention

This invention relates to pressure-sensitive label constructions of the type in which a label is adhered by pressure-sensitive adhesive on its bottom side to a release layer for subsequent removal from the release layer and adhesion to a different substrate by the same pressure-sensitive adhesive.

2. Discussion of the Prior Art

Printed or printable self-adhesive labels, i.e., of the type having a pressure-sensitive adhesive on the bottom or sticky side, are well known. They may be provided in sheet or roll form. For example, a manufacturer of products, for example bottled products, may order labels from a label printer who will make the labels by printing them on pressure-sensitive sheet stock. Such sheet stock is typically a label layer adhered by its bottom adhesive surface to a release layer. The release layer is typically coated with a silicone or other material so that the label layer can subsequently be removed from the release layer with essentially no adhesive residue left on the release layer, with the adhesive layer intact to adhere the label layer to the end substrate, i.e., to the manufacturer's bottle. After the labels are removed from the release layer, the release layer is discarded.

The label stock is typically provided to the label printer in roll form, with the self-adhesive label layer covering the entire surface of the release layer, and the label printer prints multiple labels, scores through the label layer down to the release layer, and strips the waste matrix off from around the printed labels. Strips of the printed labels are then rolled and delivered to the manufacturer for application by the product manufacturer to the manufacturer's products. This is typically done by automatic machinery. After the labels are removed from the release layer, the release layer is typically discarded.

In the past, it was typical that only one side of the release layer was treated with the release coating, and therefore, the pressure-sensitive label layer was only provided on one side of the release layer, which was the treated side. In addition, the release layer was used as merely a carrier for the pressure-sensitive labels. As a result, use of the release layer was not fully realized, resulting in excessive waste.

SUMMARY OF THE INVENTION

An object of the invention is to provide a label construction in which a release layer has release coating on opposite sides thereof so as to form a core of a three-ply label construction in which the outer plies are pressure-sensitive labels, and the inner ply is the release layer. Thus, the invention enables the delivery of approximately twice as much surface area of labels per unit area of release layer, as the prior art.

In another aspect, the invention provides booklet constructions which use the core release layer as a structural component of the booklet. Separate labels may be provided on one or both sides of the booklet, and an edge of one of the labels on the outside of the booklet may have an edge which extends past the release liner so it can be adhered to the leaf below it to hold the booklet closed.

In addition, a label construction of the invention can be provided in roll form, to more fully utilize the release layer and reduce waste.

These and other objects and advantages of the invention will be apparent from the detailed description and the drawings.

BRIEF DESCRIPTION OF THE DRAWINGS

FIG. 1 is a front plan view of a booklet label construction incorporating the invention;

FIG. 2 is a perspective view of the booklet of FIG. 1 illustrated partially open;

FIG. 3 is a cross-sectional view from the plane of the line 3—3 of FIG. 1;

FIG. 4 is a perspective view of the booklet of FIG. 2 fully opened;

FIG. 5 is a perspective view of a rolled-up label construction of the invention;

FIG. 6 is a cross-sectional view from the plane of the line 6—6 of FIG. 5;

FIG. 7 is a view similar to FIG. 2 but of a second embodiment of a booklet label construction of the invention;

DETAILED DESCRIPTION OF THE PREFERRED EMBODIMENTS

Figure 8:
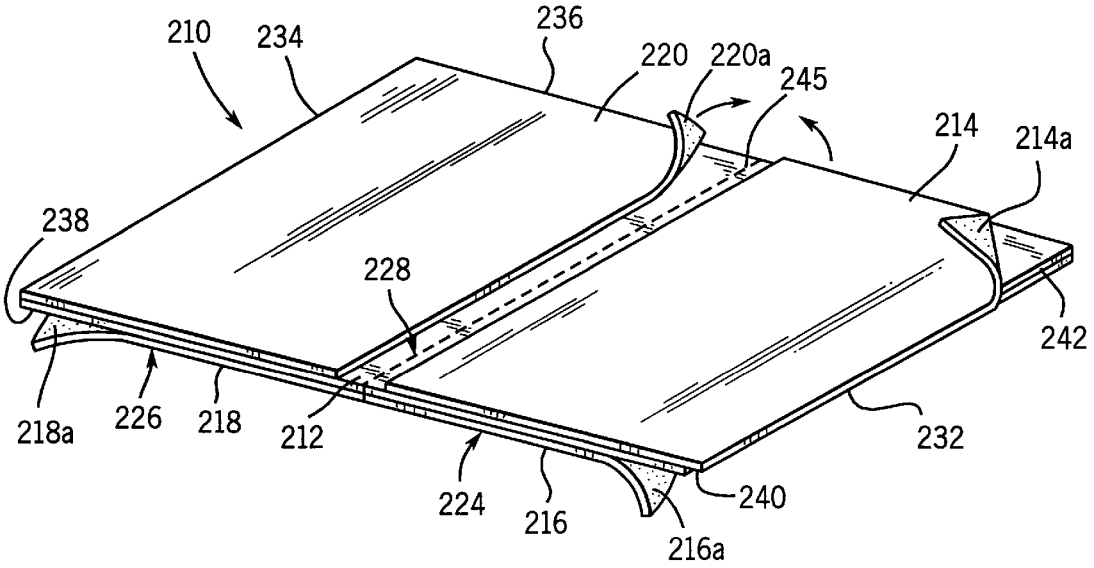
FIG. 8 is a view similar to FIG. 4 but of the embodiment of FIG. 7 fully opened.

FIG. 1 illustrates a booklet-type label construction 10 of the invention. Referring also to FIGS. 2–4, the construction 10 includes as a core layer a release layer 12 which is coated on both of its sides with a release material, the most common of which is a silicone material. The release materials themselves and the method of coating them on webs form no part of the present invention, and are well-known in the art.

The label construction 10 also includes a number of labels 14, 16, 18, and 20. Each of the labels 14, 16, 18, and 20 is a web, for example paper or plastic, which bears on its bottom side, i.e., the side facing the release layer 12, a pressure-sensitive adhesive 14*a*, 16*a*, 18*a*, or 20*a*, respectively. Each of the labels 14, 16, 18, and 20 is preferably either printed or printable, so as to bear printed indicia 22, which may be the same or different from one label to another. Any suitable material may be used for the labels 14, 16, 18, and 20, and any suitable pressure-sensitive adhesive which can be removed from the release layer 12 and remain tacky so as to adhere the respective label to the desired substrate, for example a plastic or glass bottle, a paperboard container or other container, may be used. In the preferred embodiment, the following materials were found suitable for: the release liner 12–40 lb. liner with silicone release coating on both sides; the web of the labels 14, 16, 18, and 20—paper, semi-gloss paper or plastic film face sheet material; and the adhesive layers 14*a*, 16*a*, 18*a*, and 20*a*—the adhesive sold under the commercial designation B-92 by Brownbridge Industries, Troy, Ohio or the adhesive sold under the commercial designation R-110 by Fasson, Painesville, Ohio. Other materials may be used to practice the invention. The adhesive used may be permanent, i.e., after it is removed from the liner 12 and adhered to a substrate, it cannot be easily removed, or non-permanent, i.e., after it is removed from the liner 12 and adhered to a substrate, it can be easily removed.

The booklet 10 has two leaves 24 and 26 which are joined by a fold line 28. Label 14 is on the outside of leaf 24 and label 16 is on the inside of leaf 24. Label 20 is on the outside and label 18 is on the inside of leaf 26. The label construction 10 has end edges 32 and 34 which are opposite from one another and opposite side edges 36 and 38. The edge 32 is defined by an extending edge 40 of the label 14 which extends beyond the adjacent end 42 of the release layer 12, which exposes an area of adhesive 14*a* on the bottom or inwardly-facing side of the extending edge 40.

The fold line 28, which is positioned along the end edge 44 of label 16, is positioned so that the extending edge 40 overlaps onto an area of the leaf 26, i.e., the inwardly-facing side at the end edge of label 18, so as to adhere to the inwardly-facing side of leaf 26 to hold the booklet 10 shut. At the end edge 42 of the release layer 12, which is inside of the end edge 32 of the booklet 10, the inside label 16 is aligned with, or co-terminus with, the end edge 42, so that it also is spaced inwardly from the end edge 32. At the side edges, 36 and 38 of the label 10, all of the layers of the label 10 are preferably aligned with one another in the booklet construction to make maximum use of the printable area.

FIG. 5 illustrates a roll 100 of a label construction of the invention. In the roll 100, elements corresponding to elements of the label 10 have been labeled with the same reference number plus 100.

The label roll construction 100 is identical to the label construction 10, except that more than two labels 114, 116, 118 and 120 are provided on each side of the release layer 112, the side edges of the labels are spaced inwardly from the side edges of the release layer, and the label construction is not folded but is rolled. Since it is rolled, there is no need to define a fold line with an edge of a label as at 44, or for providing a means to hold a booklet closed, like the extending edge 40 in the label construction 10. If labels are applied from the roll 100 by automatic machines, after the labels on one side are dispensed onto the end product, the release liner, still bearing the labels on the other side, can be rolled up to prepare it to be run through the label applying machine a second time to dispense the labels on the other side onto the end product After all the labels are removed from both sides of the release liner, the release liner can be discarded or rolled up for recycling.

Figure 9:
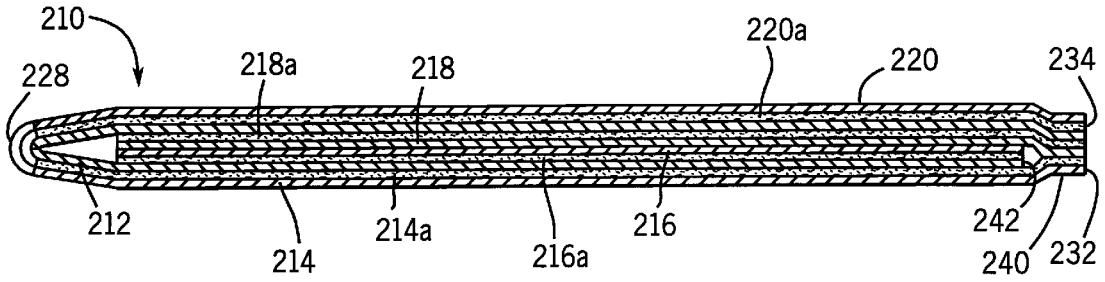
FIG. 9 is a view similar to FIG. 3 but of the embodiment of FIG. 7.

FIGS. 7–9 illustrate a booklet label construction 210 which is similar to the booklet 10. In the label construction 210, elements corresponding to the elements of the booklet 10 have been labeled with the same reference number plus 200.

The label construction 210 is the same as the label construction 10, except the fold line 228 is not defined by an end edge of one of the interior label layers, but is defined by an intermittent perforation line 245 of spaced perforations. In addition, the exterior labels 216 and 218 are provided in one continuous layer, and the perforation 245 extends through the labels 216 and 218. Thus, the labels 216 and 218 are only separated when the label 210 is torn along the perforation 245.

Preferred embodiments of the invention have been described in considerable detail. Many modifications and variations of the preferred embodiments described will be apparent to those skilled in the art which will still incorporate the invention. Therefore, the invention should not be limited to the embodiments described, but should be defined by the claims which follow.

We claim:

1. In an individual label construction of the type having a label layer with a pressure-sensitive adhesive on its bottom side and a release layer with a release surface releasably-adhered to said bottom side by said pressure-sensitive adhesive, the improvement wherein said individual label construction includes at least two label layers, each said label layer having a pressure-sensitive adhesive on a bottom side thereof, and said release layer has two opposite sides, each said side being releasably adhered to the bottom side of one of said label layers so that said release layer is between said label layers, and wherein said layers have edges which circumscribe the perimeter of said individual label construction such that said layers together make up said individual label construction.

2. The improvement of claim 1, wherein each said label layer bears printed indicia different from the printed indicia of at least one other label layer of said individual label construction.

3. The improvement of claim 1, wherein said release layer is folded along a fold line which extends from one edge of said release layer to another edge thereof so that said individual label construction forms a booklet having at least two leaves.

4. The improvement of claim 3, wherein each said leaf has a portion which is at least three plies in thickness, with outer plies each being one of said label layers and an inner ply being said release layer.

5. The improvement of claim 4, wherein said label layers on one side of said release layer are defined by a common label layer which extends over said fold line from one said leaf to the other.

6. The improvement of claim 5, wherein said fold line is perforated through said release layer and said common label layer at spaced locations along it.

7. The improvement of claim 5, wherein each leaf has a label layer which is separate from a label layer on the other said leaf on the side of said release layer which is opposite from said one side of said release layer.

8. The improvement of claim 3, wherein said individual label construction has a first end edge on one leaf and a second end edge on the opposite leaf and said first end edge is formed by an extending edge of said label layer of said one leaf which is on the outside of said leaf, said extending edge extending past an adjacent edge of said release layer of said one leaf so as to expose an area of pressure-sensitive adhesive on an inwardly-facing side of said extending edge, said area of pressure-sensitive adhesive overlapping onto an inwardly-facing side of said opposite leaf when said booklet is closed to hold said booklet closed.

9. The improvement of claim 1, wherein at least one side of said release layer mounts two or more separate label layers.

10. The improvement of claim 3, wherein the inside of said booklet has two separate label layers and an edge of at least one of said label layers is positioned at said fold line.

11. The improvement of claim 10, wherein said two separate label layers are spaced apart.

12. The improvement of claim 1, wherein at least two opposite edges of each of said label layers and release layer are aligned with adjacent edges of said label layers and release layer.

13. In a strip of labels of the type having a series of individual label layers with a pressure-sensitive adhesive on a bottom side of each label layer and a release layer releasably-adhered to said bottom sides by said pressure-sensitive adhesive, said release layer carrying said individual label layers, the improvement wherein said construction includes individual label layers on each side of said release layer, each said label layer having a pressure-sensitive adhesive on a bottom side thereof, and said release layer has two opposite sides, each said side being releasably adhered to the bottom sides of said label layers so that said release layer is between said label layers on opposite sides thereof, and wherein the label layers on each side of said release layer are spaced apart from one another by a certain distance so as to expose an area of said release layer between adjacent individual label layers on each side of said release layer.

* * * * *